US011559139B2

(12) United States Patent
Ervin

(10) Patent No.: US 11,559,139 B2
(45) Date of Patent: Jan. 24, 2023

(54) WINE RACK APPARATUS

(71) Applicant: Todd Ervin, Lansing, MI (US)

(72) Inventor: Todd Ervin, Lansing, MI (US)

( * ) Notice: Subject to any disclaimer, the term of this patent is extended or adjusted under 35 U.S.C. 154(b) by 0 days.

(21) Appl. No.: 17/490,327

(22) Filed: Sep. 30, 2021

(65) Prior Publication Data

US 2022/0095792 A1 Mar. 31, 2022

Related U.S. Application Data

(60) Provisional application No. 63/204,378, filed on Sep. 30, 2020.

(51) Int. Cl.
*A47B 73/00* (2006.01)

(52) U.S. Cl.
CPC ..... *A47B 73/006* (2013.01)

(58) Field of Classification Search
CPC ..... A47B 73/006; A47B 73/00; A47B 73/008; A47F 7/28; A47F 7/283; A47F 7/285; A47F 7/0021; A47F 7/0028; A47F 7/0035; A47F 5/08; A47F 5/0815; A47G 23/02; A47G 23/0241
USPC ..... 211/74, 75, 85.18, 85.21, 85.22; 248/309.1, 310, 311.2, 311.3, 314, 312.1, 248/315
See application file for complete search history.

(56) References Cited

U.S. PATENT DOCUMENTS 252,065 A 1/1882 Thomas
1,601,040 A * 9/1926 Phillips ..... A47F 7/283 248/129
1,962,608 A * 6/1934 McEachern ..... A47F 7/288 211/74
1,975,691 A * 10/1934 Hibbs ..... A47K 1/09 222/93
2,145,879 A * 2/1939 Jewett ..... A47F 7/285 211/74
2,155,884 A * 4/1939 Barnes ..... A47J 47/16 211/74
2,338,310 A * 1/1944 Barnes ..... A47B 73/00 211/74
2,419,040 A * 4/1947 Stepanian ..... A47L 19/04 211/74
2,580,676 A * 1/1952 Gross ..... A47B 73/00 211/75
2,733,883 A * 2/1956 Gourley ..... A61J 9/0638 248/314
2,749,004 A * 6/1956 Hilts ..... B67D 3/0029 141/237
2,801,066 A * 7/1957 Clare ..... G09F 1/08 248/314
2,917,183 A * 12/1959 Seelye ..... B01L 9/06 211/74
3,033,375 A * 5/1962 Cole ..... A47F 7/28 211/75

(Continued)

FOREIGN PATENT DOCUMENTS

GB 2253344 4/1992

*Primary Examiner* — Jennifer E. Novosad
(74) *Attorney, Agent, or Firm* — Gunther Evanina; Butzel Long

(57) ABSTRACT

A bottle rack has a panel with a plurality of receptacle apertures and a corresponding plurality of cylindrical receptacles, each cylindrical receptacle having a receptacle opening located at the corresponding aperture and projecting away from a rear face of the panel.

6 Claims, 3 Drawing Sheets

(56) References Cited

U.S. PATENT DOCUMENTS 3,039,616 A * 6/1962 Proffit ..... B60N 3/106 211/74
3,259,445 A * 7/1966 Saxon ..... A47B 77/16 312/234.5
3,650,381 A * 3/1972 Weindling ..... A47F 5/08 211/195
4,378,889 A * 4/1983 Lebowitz ..... A47F 7/283 211/74
4,405,108 A * 9/1983 Muirhead ..... A47F 5/0823 211/DIG. 1
4,557,456 A * 12/1985 Mueller ..... A47F 5/0815 248/220.31
4,793,097 A * 12/1988 Whitcomb ..... A01G 9/0297 211/74
4,819,815 A * 4/1989 Tarlow ..... A47F 7/285 211/74
4,887,726 A * 12/1989 Cizaire ..... A47B 73/004 211/74
5,186,341 A * 2/1993 Zeid ..... A47B 61/003 211/204
5,397,006 A * 3/1995 Terrell ..... A47F 5/0846 211/74
5,494,087 A * 2/1996 Pitelka ..... B65B 3/003 141/2
5,676,340 A * 10/1997 Ruhnau ..... B60N 3/103 248/314
5,678,701 A * 10/1997 Anderson ..... A47F 7/285 248/312.1
5,904,257 A * 5/1999 Marmet ..... A47F 3/001 211/75
5,947,305 A * 9/1999 Lin ..... A47B 73/006 211/74
6,047,837 A * 4/2000 Kessens ..... A47F 7/283 211/181.1
6,116,434 A * 9/2000 Park ..... B25H 3/04 211/90.01
6,220,458 B1 * 4/2001 Falor ..... A47G 23/0241 211/74
6,230,905 B1 * 5/2001 Camblor ..... A47B 73/004 403/321
6,274,092 B1 * 8/2001 Itoh ..... B01L 9/06 422/65
6,360,558 B1 * 3/2002 Woog ..... F25D 31/007 206/427
6,443,316 B1 * 9/2002 Mao ..... A47L 19/04 211/74
6,964,343 B2 * 11/2005 Tilly ..... A47B 77/16 211/74
6,991,117 B2 1/2006 McCain
7,004,336 B2 * 2/2006 Dagan ..... A47B 73/006 211/74
7,232,039 B2 * 6/2007 Doran ..... B65D 71/50 211/74
D548,026 S * 8/2007 Whiteman ..... D7/701
7,269,970 B2 * 9/2007 Robertson ..... F25D 3/06 62/457.5
7,506,771 B2 * 3/2009 Bianchini ..... A47B 73/00 211/75
7,533,776 B2 * 5/2009 Nickerson ..... A47B 81/007 211/74
7,757,868 B2 * 7/2010 Bianchini ..... B25H 3/04 211/75
7,922,015 B2 * 4/2011 Bassetti ..... F25D 31/007 211/74
7,987,983 B1 * 8/2011 Guitreau ..... A47F 7/0028 211/74
8,128,043 B2 * 3/2012 Walter ..... A47B 96/061 248/221.11
8,267,259 B2 * 9/2012 Fisher ..... A47B 73/004 211/89.01
8,403,156 B1 * 3/2013 Boone ..... A47F 7/283 211/75
8,439,209 B2 * 5/2013 Strollo ..... A47B 81/00 211/75
8,607,994 B1 12/2013 Schneider
8,640,889 B2 * 2/2014 Gasper ..... A47F 5/0823 211/74
8,789,713 B2 * 7/2014 Koller ..... A61B 50/24 211/74
10,561,238 B1 * 2/2020 Gutierrez ..... A47F 7/283
10,737,836 B2 * 8/2020 Carpenter ..... B65D 23/12
11,191,355 B2 * 12/2021 Wang ..... A47B 73/004
2002/0009397 A1 * 1/2002 Hirono ..... B01L 9/06 211/74
2002/0108917 A1 * 8/2002 Maruyama ..... B01L 9/50 211/74
2012/0325759 A1 12/2012 Hogeback
2013/0277322 A1 * 10/2013 Tiberio ..... A61B 50/20 211/74
2022/0095792 A1 * 3/2022 Ervin ..... A47B 73/00

* cited by examiner

FIG. 3
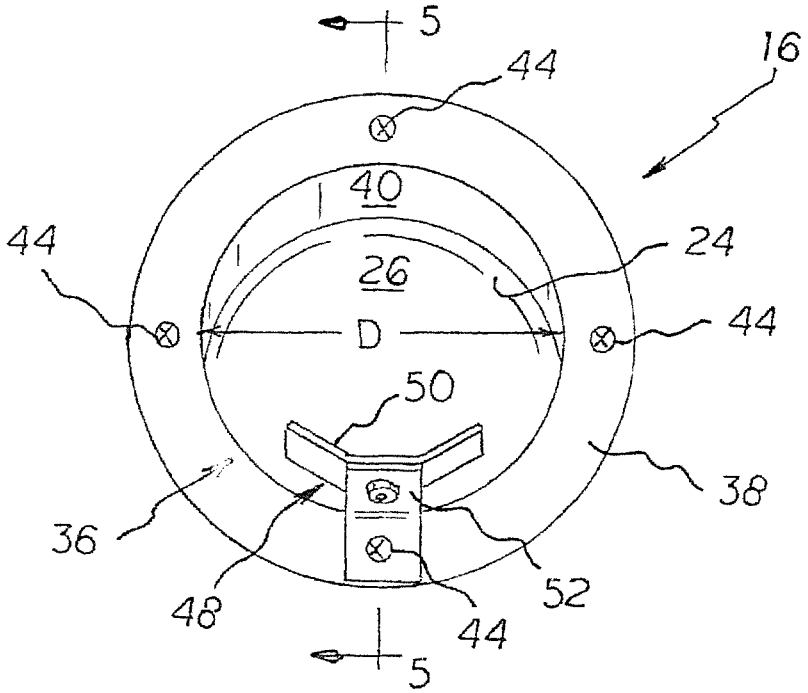
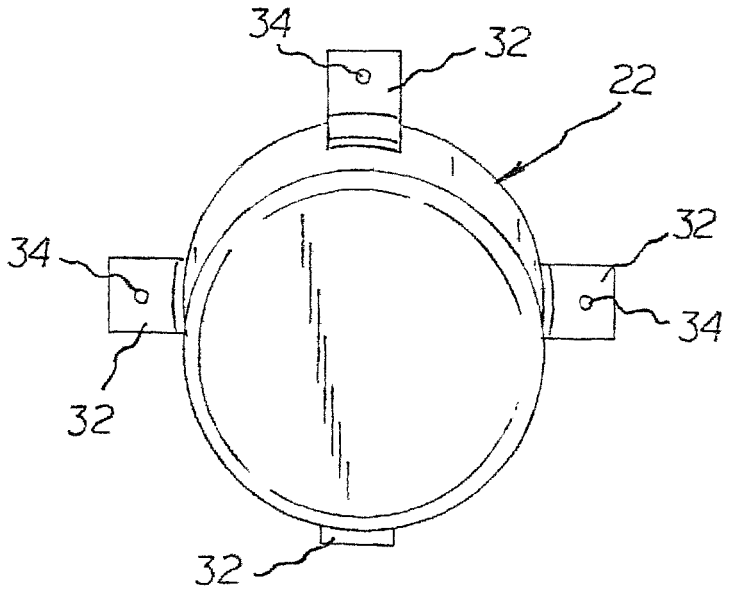
FIG. 4

WINE RACK APPARATUS

CROSS-REFERENCE TO RELATED APPLICATIONS

This application claims priority to provisional Application No. 63/204,378, filed on Sep. 30, 2020 and is incorporated herein by reference in its entirety.

FIELD OF THE DISCLOSURE

The disclosure relates to storage racks, particularly bottle racks such as for wine.

SUMMARY OF THE INVENTION

The present invention relates generally to article storage assemblies, and more specifically, to a wine bottle rack built into and supported on a vertical panel structure. The panel structure extends upright to define an outward facing front face, and contains a series of through apertures or openings, each of which has associated with it a corresponding cylindrical container or receptacle sized and configured suitably to receive the bottom portion of a wine bottle in the space behind the panel. Each wine bottle has its neck, and middle portion extending forwardly beyond the panel's front face at a slight upwardly tilted angle to the horizontal when so emplaced. A suitable bracket attached to the container assembly extends forwardly with respect to the panel's front face to engage and provide support for the middle portion of each emplaced wine bottle, respectively.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein:

FIG. 3 is an enlarged front view of the wine-bottle-receiving container taken along line 3-3 in FIG. 2.

FIG. 4 is an enlarged rear view of the wine-bottle-receiving container taken along line 4-4 in FIG. 2.

DETAILED DESCRIPTION

With reference to the drawings, at least one preferred embodiment of a new and improved wine rack apparatus embodying the principles and concepts of the present invention now will be described in sufficient detail to provide a complete "written description" of the invention.

Figure 1:
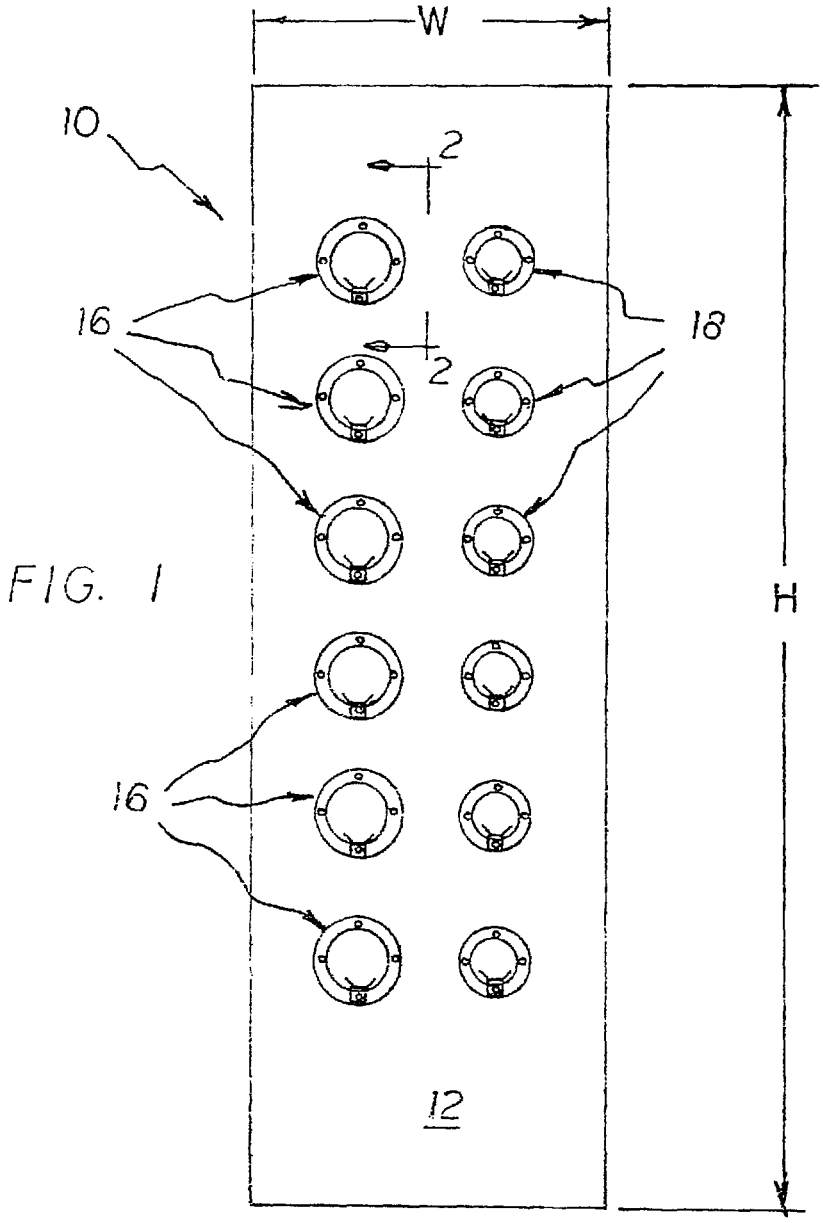
FIG. 1 is a front view in elevation of a preferred embodiment of the wine rack apparatus according to the present invention showing the front panel face thereof and a series of wine-bottle-receiving openings therein.
Figure 2:
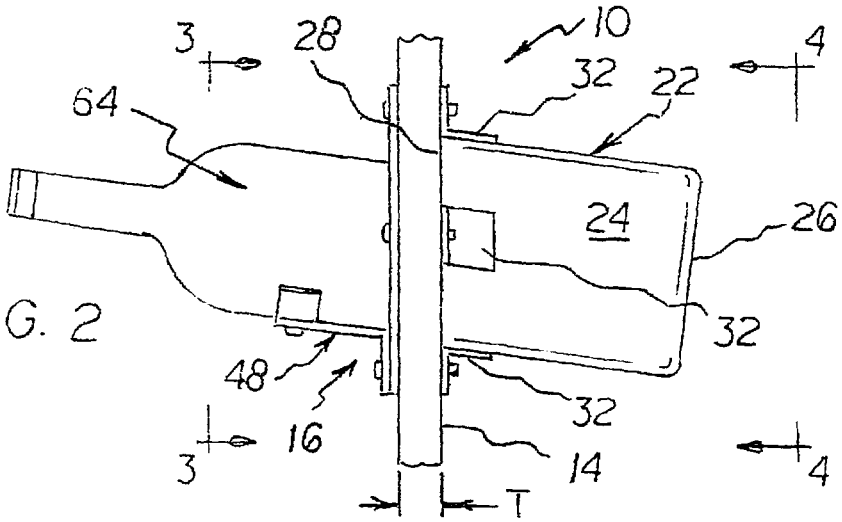
FIG. 2 is a side view in elevation taken along line 2-2 of FIG. 1 showing schematically a wine bottle received through one of the openings in the wine rack apparatus panel and having its bottom portion received in and supported by a corresponding wine-bottle-receiving container.

Turning initially to FIG. 1, there is shown a generally rectangularly-shaped panel member 10 disposed in vertical disposition and having a height "H", a width "W" and a thickness "T." The panel 10 defines a front facing surface 12 and an opposed rear facing surface 14. Supported on the panel member 10 is a first column of regularly spaced wine-bottle-receiving assemblies 16 and a second column of spaced wine-bottle-receiving assemblies 18, substantially as depicted. The wine bottles can be unopened, empty, or partially filled with wine or the like. Assemblies 16 and 18 are identical, but for their size, i.e., assemblies 16 are somewhat larger in diameter than assemblies 18 to receive wine bottles of differing corresponding size, respectively. Assemblies 16 and 18 are supported on panel 10 via corresponding through-openings 20 in the panel member extending between the panel member's front surface 12 and opposed rear surface 14 as will be made more evident below.

The panel member can be a board of wood or similar material, a wall section, or any other relatively strong, stiff, durable material capable of supporting the weight of as many wine bottles as are intended to be stored therein. Obviously, the exact number of rows and columns of assemblies 16, 18 arranged on or in the panel member is a matter of design choice.

Turning now to FIGS. 2-6, the top-most wine-bottle-receiving assembly 16 in the first column now will be described in detail, it being understood that all such assemblies on the panel 10 are substantially identical in construction, but for size, and therefore a description of one will suffice for all.

Each wine-bottle-receiving assembly 16 comprises a wine-bottle-receiving container or receptacle preferably in the form or shape of a hollow cylindrical can-like structure generally represented by reference sign 22 having a cylindrical sidewall 24, a substantially flat bottom 26, and a top edge 28 defining a distal mouth or opening 30 for the can structure 22. Located exteriorly on the can structure sidewall 24 proximal to opening 30 is a series of four right-angle panel fastening tabs 32 suitably permanently affixed to the can structure 22, as by welding, substantially as depicted. Each panel fastening tab 32, in turn, contains more or less centrally thereof a female-threaded fastener receiving opening 34, respectively. As schematically shown (FIG. 4), the panel fastening tabs 32 are substantially equally spaced relative to each other with respect to the cylindrical peripheral extent of the can structure 22.

Figure 5:
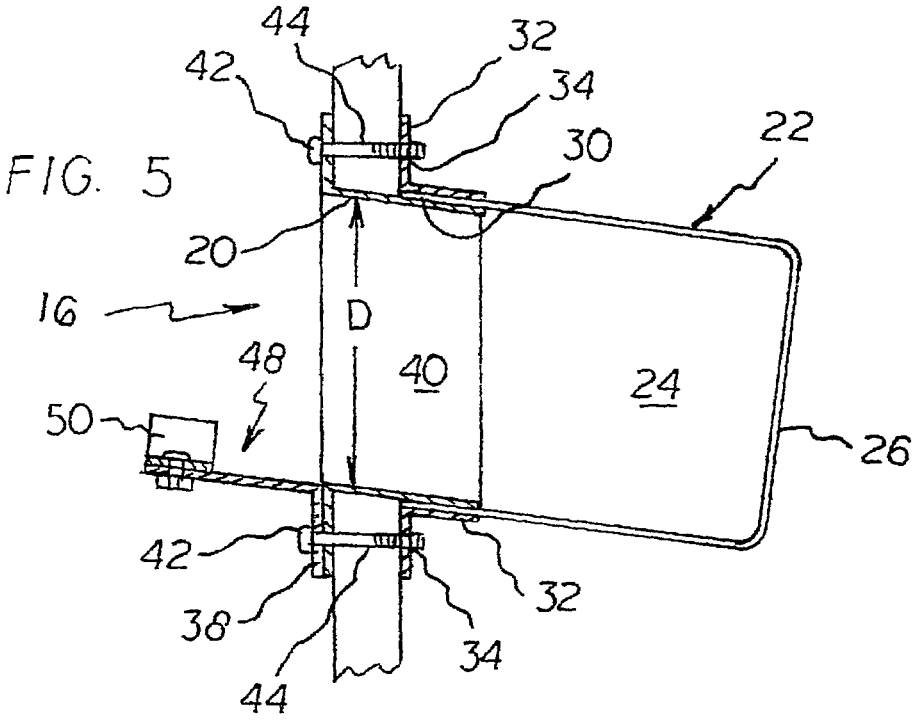
FIG. 5 is a cross-sectional view taken along line 5-5 in FIG. 3.

Each wine-bottle-receiving assembly 16 additionally comprises a mounting ring generally represented by reference number 36 for attachment to the panel member 10 front face and to the fastening tabs 32 on can structure 22. To accomplish these functions, mounting ring 36 comprises a cylindrical flange or lip 38 extending radially from the top of an integral cylindrical skirt member 40. The diameter of cylindrical skirt member 40 is chosen to be slightly less than the diameter of mouth or opening 30 of can structure 22 such that the skirt member 40 can be co-axially inserted within opening 30 when the parts are assembled to each other and to the panel member 10, substantially as depicted in FIG. 5. When so assembled, the diameter or opening "D" (FIGS. 3 and 5) defined by skirt member 40 defines the mouth or opening of the wine-bottle-receiving assembly 16.

Figure 6:
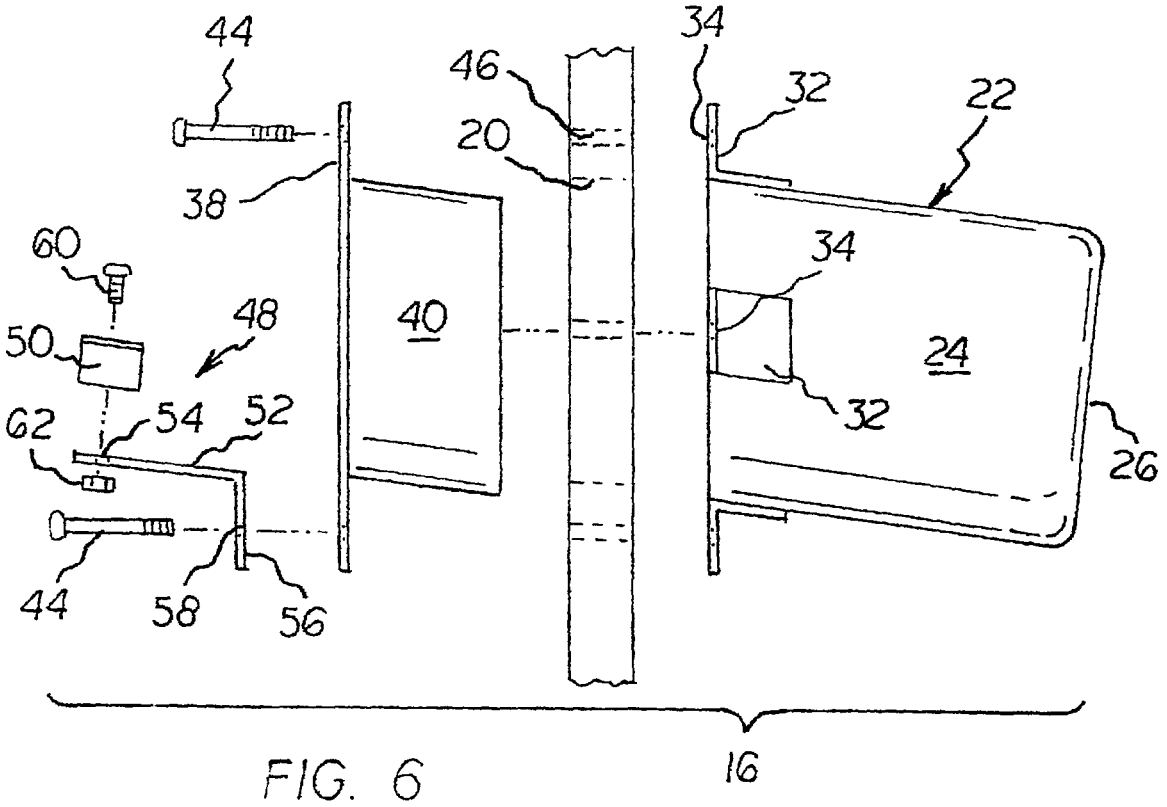
FIG. 6 is an exploded assembly side view of the wine rack apparatus shown in FIG. 2.

As schematically shown in FIGS. 5 and 6, a series of openings 42 are provided in flange 38 equally spaced around the circumferential extent of the flange. The mounting ring and flange are sized to assure that openings 42 are radially spaced from the imaginary central axis (not shown) of the mounting ring the same radial distance as openings 34 on panel fastener tabs 32 are spaced from the imaginary central axis (not shown) of can structure 22. By this construction, when the mounting ring skirt member 40 is co-axially inserted within opening 30 and the parts are assembled to each other and to the panel member 10 as aforesaid, the openings 42 will align with the openings 34. Thus, all that is necessary to securely affix the mounting ring 36 and the can structure 22 to each other and to the panel member 10 is to insert provided male-threaded fasteners 44 into aligned openings 34, 42 and tighten in place sufficiently, substantially as depicted in FIG. 5. It will be appreciated that openings 46 suitably are provided in the panel structure member 10 corresponding to aligned openings 34, 42 to accommodate threaded fasteners 44 (FIGS. 5 and 6).

Preferably, a front-projecting support bracket generally represented by reference sign 48 for engaging what is normally the upper portion of each wine bottle received in assembly 16 is attached to the lower portion of the mounting ring 36 (see FIGS. 2, 3, 5 and 6). Substantially as depicted, support bracket 48 comprises an arcuate-segment support cradle 50, a right-angle fastening tab having a first portion 52 with an opening 54, and a second portion 56 with an opening 58. A provided fastener comprising screw 60 and complimentary nut 62 inserted through opening 54 can be used to affix the arcuate-segment support cradle 50 to the first portion 52 of the fastening tab whereas the second portion 56 of the fastening tab can be affixed in place via the bottom-most mounting ring threaded fastener 44 being inserted through opening 58, as best seen in FIGS. 3, 5 and 6.

Each received wine bottle in each wine-bottle-receiving assembly or receptacle 16 on panel member 10 can be supported in a slight "tilted up" position. This is clearly depicted in FIG. 2 where wine bottle 64 has its normally bottom portion (not shown) supported inside and by hollow cylindrical can 22, its normally upper portion supported by bracket 48, and its protruding neck and closure top portion "tilted up" with respect to a horizontal plane normal to the plane of the paper. In other words, the cylindrical receptacle has a cylindrical axis that is tilted at an angle relative to a line normal (perpendicular) to the rear face of the panel. To achieve this desired arrangement, it is necessary to form the cylindrical can such that its top edge 28 is disposed at the desired angle of tilt with respect to the imaginary central axis of cylindrical sidewall 24 and substantially flat bottom 26. When this is suitably done, the hollow cylindrical wine-bottle-receiving can 22 "tilts" down and to the right, away from the rear surface of panel member 10. Similarly, as schematically shown in FIGS. 5 and 6, it is necessary to form mounting ring cylindrical skirt member 40 such that it is attached to flange 38 at the desired angle of tilt with respect to the imaginary central axis of the flange extending normal to an imaginary plane passing through the flange.

In accordance with the invention the "desired angle of tilt" preferably falls within the range of about 12 degrees to about 20 degrees with a tilt angle of 15 degrees being mostly preferred. By storing each wine bottle in the wine rack apparatus of the invention in a "tilted up" mode assures that each wine bottle is securely supported therein and presents a pleasing aesthetic appearance overall.

The foregoing detailed description is considered as illustrative only of the principles of the invention. Numerous modifications and changes will readily occur to those skilled in the art and therefore, it is not desired to limit the invention to the exact construction and operation shown and described. Accordingly, all suitable modifications and equivalents falling within the broad scope of the subject matter described above may be resorted to in carrying out the present invention.

The invention claimed is:

1. A bottle rack, comprising:

a panel having a front face, a rear face and a plurality of receptacle apertures;

a plurality of receptacles, each having a cylindrical cross-section, each cylindrical receptacle being associated with a corresponding one of said plurality of receptacle apertures and being attached to the panel with a receptacle opening located at the corresponding receptacle aperture and each cylindrical receptacle projecting away from the rear face of the panel; and a plurality of support brackets, each support bracket projecting away from the front face of the panel adjacent a bottom edge of a corresponding receptacle aperture, each support bracket configured for engaging an upper portion of a bottle supported in one of the cylindrical receptacles;

wherein each cylindrical receptacle has a cylinder axis that is tilted at an angle with respect to a line normal to the rear face of the panel.

2. The bottle rack of claim 1, further comprising a plurality of fastening tabs adjacent the receptacle opening of each receptacle, the panel and fastening tabs having aligned fastener apertures adapted to receive a fastener for securing each receptacle to the panel.

3. The bottle rack of claim 2, further comprising a plurality of mounting rings, each mounting ring associated with a corresponding cylindrical receptacle and having fastener apertures aligned with those of the corresponding fastening tabs.

4. The bottle rack of claim 1, wherein at least one of the receptacle apertures has a size different than another receptacle aperture.

5. The bottle rack of claim 1, wherein the support bracket has an arcuate-segment support cradle.

6. The bottle rack of claim 1, wherein the angle is from 12 degrees to 20 degrees.

* * * * *